US006030193A

United States Patent [19]

Kimura

[11] Patent Number: 6,030,193

[45] Date of Patent: Feb. 29, 2000

[54] SCROLL TYPE FLUID MACHINE HAVING AN IMPROVED OLDHAM RING

[75] Inventor: Yoshio Kimura, Maebashi, Japan

[73] Assignee: Sanden Corporation, Gunma, Japan

[21] Appl. No.: 08/953,729

[22] Filed: Oct. 17, 1997

[30] Foreign Application Priority Data

Oct. 22, 1996 [JP] Japan ..... 8-279121

[51] Int. Cl.[7] ..... F01C 1/04

[52] U.S. Cl. ..... 418/55.3

[58] Field of Search ..... 418/55.3; 464/102

[56] References Cited

U.S. PATENT DOCUMENTS

| | | | |
|---|---|---|---|
| 3,924,977 | 12/1975 | McCullough | 418/57 |
| 4,325,683 | 4/1982 | Miyazawa | 418/55.3 |
| 4,406,600 | 9/1983 | Terauchi et al. | 418/55.3 |
| 4,874,302 | 10/1989 | Kobayashi et al. | 418/55.6 |

FOREIGN PATENT DOCUMENTS

| | | | |
|---|---|---|---|
| 2176177 | 9/1990 | Japan . | |
| 2-283882 | 11/1990 | Japan | 418/55.3 |
| 2259967 | 9/1992 | United Kingdom . | |

*Primary Examiner*—John J. Vrablik
*Attorney, Agent, or Firm*—Baker & Botts L.L.P.

[57] ABSTRACT

In a scroll type fluid machine comprising a compressor housing, a front end plate (4) fixed within the compressor housing, a fixed scroll member, and a movable scroll member (14), an Oldham ring (26) is placed between the front end plate and the movable scroll member to prevent self-rotation of the movable scroll member. The Oldham ring comprises a plurality of keys (26*a*, 26*b*). The front end plate and the movable scroll member have housing keyways (4*a*) and scroll keyways (15*a*), respectively, formed therein, for receiving the keys. A pair of semi-circular members (40*a*) are assembled to form a ring member on at least one of the front end plate and the movable scroll member and receives a thrust load acting on the movable scroll member. The semi-circular member has ends bent to form bent sections (40*b*). The bent sections are inserted into the housing keyway or the scroll keyway. The key is within the housing keyway or the scroll keyway when the bent section is within the keyway to receive sliding of the key.

6 Claims, 9 Drawing Sheets

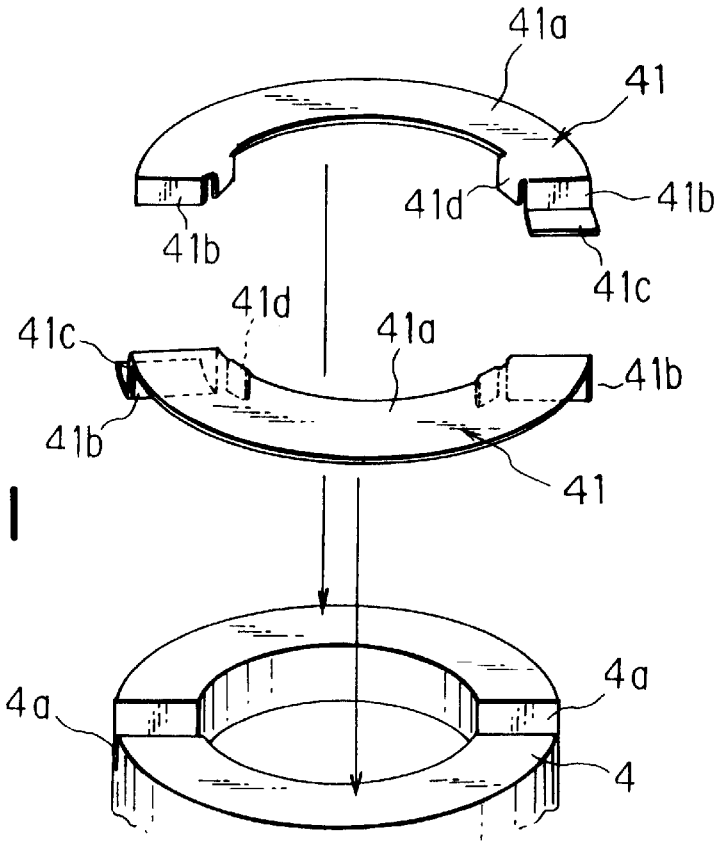
FIG. 11
FIG. 12
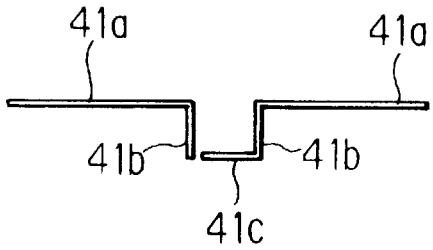
FIG. 13A
FIG. 13B
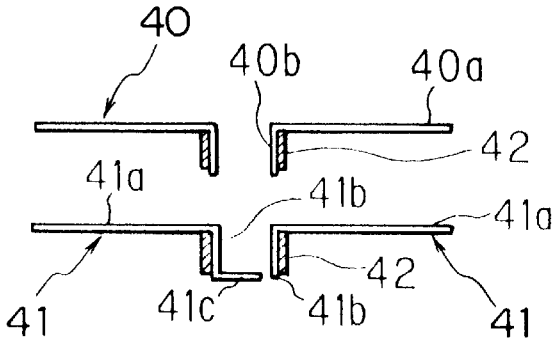

SCROLL TYPE FLUID MACHINE HAVING AN IMPROVED OLDHAM RING

BACKGROUND OF THE INVENTION

The present invention relates to a scroll type fluid machine that is to be used for a fluid compressor or a fluid expansion device.

As is well known in the art, scroll type fluid machines comprise a compressor housing, a fixed scroll member and a movable scroll member (orbiting scroll member). The movable scroll member is displaced relative to the fixed scroll member within the compressor housing. As the movable scroll member contacts the fixed scroll member, fluid pockets (closed spaces) are formed between the fixed and the movable scroll members. The movable scroll member is orbited while it is not allowed to self-rotate relative to the fixed scroll member. An Oldham ring is used for preventing such self-rotation of the movable scroll. The fluid pockets get smaller as they get closer to the center of the fixed and the movable scroll members, compressing the gas until it is discharged through the center of the scroll member.

As described more in detail below, the Oldham ring comprises several keys. The keys are used to fix the Oldham ring to a front end plate and an end plate of the movable scroll member within the compressor housing. Thus, it is necessary to form a keyway in, i.e., to spline the front end plate and the movable scroll member.

The front end plate and the movable scroll member are typically made of iron-based material. In order to form a keyway in, for example, the front end plate, the latter is cut into a desired shape. The front end plate is then ground and splined. The front end plate may be subjected to heat treatment upon formation of the keyways.

Surface finishing with high accuracy is involved in the formation of the keyways to prevent seizure or abnormal abrasion or wear of the keys. To this end, cutting, grinding, and the heat treatment should be made. These works deteriorate productivity of the keyways, increasing the manufacturing cost for them. The heat treatment causes strain in the keyways, which may make it difficult to assemble the keys.

Problems arise when the movable scroll member is subjected to heat treatment upon formation of the keyways. When the movable scroll member is heated after being cut, the movable scroll member would be deformed. On the contrary, when the movable scroll member is heated before being cut, subsequent processes would be more difficult.

The front end plate and the movable scroll member may be made of the iron-based material, taking the wear resistance into consideration. However, such the iron-based material increases the weight of the fluid machine itself.

SUMMARY OF THE INVENTION

An object of the present invention is to provide a scroll type fluid machine that can be manufactured at a high productivity with a reduced manufacturing cost.

Another object of the present invention is to provide a scroll type fluid machine having a reduced weight that can be readily machined.

A scroll type fluid machine according to the present invention comprises a compressor housing; a front end plate fixed within the compressor housing; a fixed scroll member; and a movable scroll member, the movable scroll member being displaced relative to the fixed scroll member within the compressor housing. In this scroll type fluid machine, the movable scroll member is let to cooperate with the fixed scroll member to orbit around the fixed scroll member while not allowed to self-rotate relative to the fixed scroll member by an Oldham ring. The Oldham ring comprises a plurality of keys.

According to an aspect of the present invention, the front end plate and the movable scroll member have housing keyways and scroll keyways, respectively, formed therein, for receiving the keys. A pair of semi-circular members having wear resistance are assembled to form a ring member on at least one of the front end plate and the movable scroll member. The semi-circular members receive a thrust load acting on the movable scroll member. Each of the pair of semi-circular members has ends bent to form bent sections. The bent sections are inserted into the housing keyway or the scroll keyway. The key is within the housing keyway or the scroll keyway when the bent section is within the keyway to receive sliding of the key.

BRIEF DESCRIPTION OF THE DRAWINGS

FIG. 11 is a perspective view showing another example of a plate having wear resistance that is to be provided on the front end plate;

FIG. 12 is a view showing the positional relationship between the plate in FIG. 11 having wear resistance and a keyway in the front end plate when they are engaged with each other; and FIGS. 13A and 13B are views showing an elastic member attached to a bent section of the plate having wear resistance.

DESCRIPTION OF THE PREFERRED EMBODIMENTS

Figure 1:
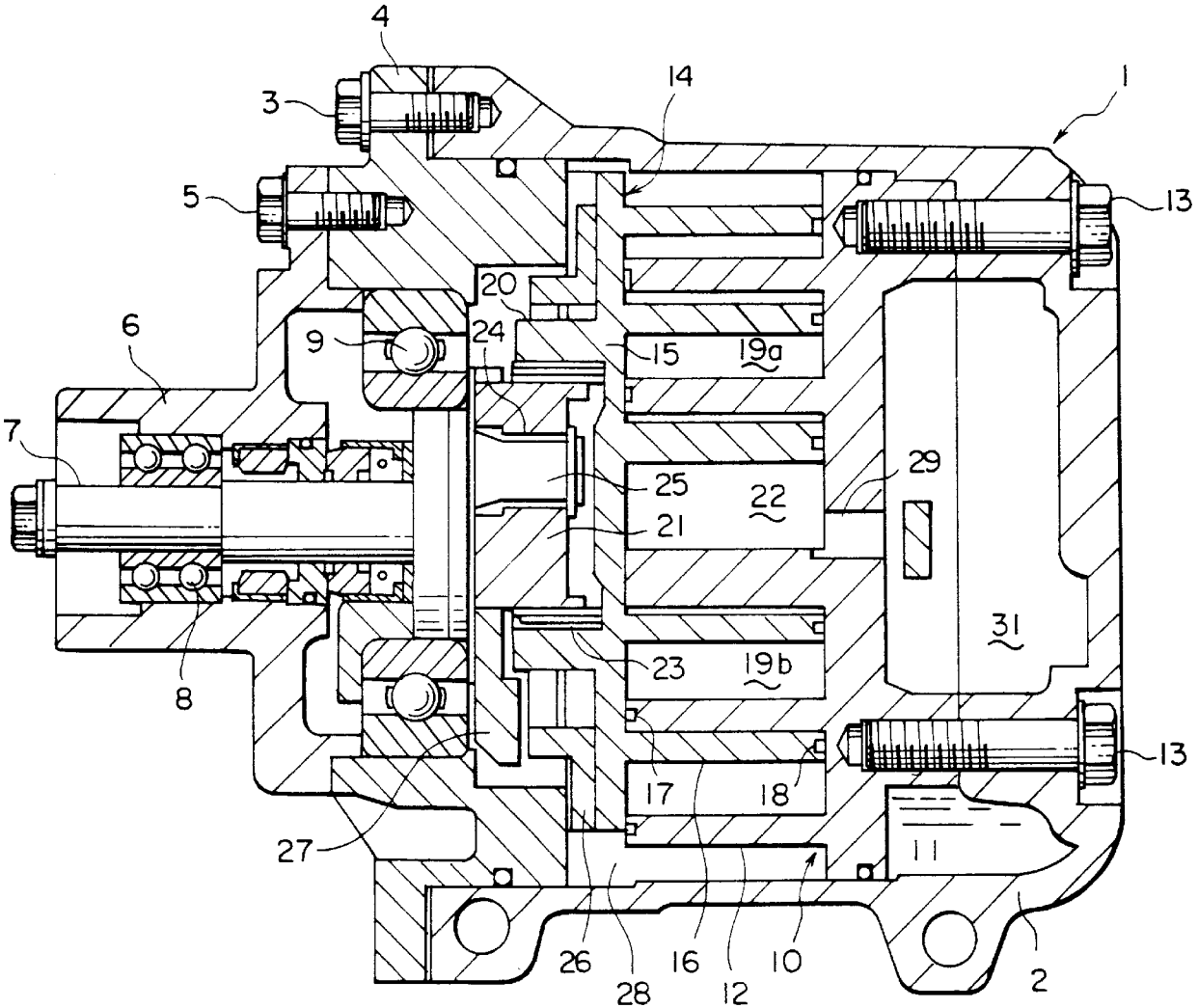
FIG. 1 PRIOR ART
FIG. 1 is a cross-sectional view showing a conventional scroll type fluid machine.

Referring to FIG. 1, a conventional scroll type fluid machine is described that is used as a compressor. In FIG. 1, the compressor comprises a compressor housing 1. The compressor housing 1 comprises a cup-shaped section 2, a front end plate (front housing) 4, and a cylindrical member 6. The front end plate 4 is secured to the cup-shaped section 2 with bolts 3. The cylindrical member 6 is secured to the front end plate 4 with bolts 5. A main shaft (rotation shaft) 7 is passed through the cylindrical member 6. The main shaft 7 is rotatably supported by the compressor housing 1 through bearings 8 and 9.

A movable scroll member 14 is displaced relative to a fixed scroll member 10 within the compressor housing 1. The fixed scroll member 10 is formed of an end plate 11 and an involute vane 12 fixed to one surface of the end plate 11. The end plate 11 is secured to the cup-shaped section 2 with bolts 13. The fixed scroll member 10 is fixed to the compressor housing 1.

Contact fixture of the end plate 11 to the cup-shaped section 2 as described above partitions the compressor housing 1 into two cavities. A discharge cavity 31 is formed outside (right side in the figure) of the end plate 11. A suction cavity 28 is formed inside (left side in the figure) of the end plate 11. A discharge outlet 29 is formed in the end plate at the center thereof. The discharge outlet 29 is opened and closed with a discharge valve which is not shown.

The movable scroll member 14 is formed of an end plate 15 and an involute vane 16 secured to one side of the end plate 15. The involute vane 16 is substantially identical in shape to the involute vane 12.

The fixed scroll member 10 is not co-axial with the movable scroll member 14. More specifically, these scroll members are eccentric with each other by an amount equal to the radius of orbit and are shifted from each other by 180 degrees. A tip seal 17 is embedded in the involute vane 12 at the front end thereof. Likewise, a tip seal 18 is embedded in the involute vane 16 at the front end thereof. The tip seal 17 is close contact with the inner surface of the end plate 15. The tip seal 18 is close contact with the inner surface of the end plate 11. The sides of the involute vanes 12 and 16 are line contact with each other at several points. As a result, crescent-shaped fluid pockets (compression chambers) 19*a* and 19*b* are formed that are symmetrical with respect to the center of the scroll member.

A cylindrical boss 20 is projected from the outer surface (left side in the figure) of the end plate 15 at the center thereof. A drive bush 21 is rotatably mounted in the cylindrical boss 20 through a swivel bearing 23. A slide groove 24 is formed in the drive bush 21. An eccentric drive pin 25 is projected from the main shaft 7 at an eccentric position on the end of the shaft. The eccentric drive pin 25 is slidably engaged with the slide groove 24. A balance weight 27 is attached to the drive bush 21 to compensate dynamic unbalance caused by the revolution or orbital movement of the movable scroll member 14. An Oldham ring 26 is placed between the outer periphery of the end plate 15 and the inner surface of the front end plate 4 to prevent the self-rotation of the movable scroll member 14. The Oldham ring 26 has a plurality of keys (not shown). The Oldham ring 26 is attached to the end plate 15 and the front end plate 4 with these keys. More specifically, the end plate 15 and the front end plate 4 each has keyways (not shown) formed therein. The keys on the Oldham ring are engaged with the keyways. This combination allows attachment of the Oldham ring 26 to the end plate 15 and the front end plate 4.

The keyways engaged with the keys on the Oldham ring 26 receive, mainly on the side thereof, a torque that restricts the self-rotation of the movable scroll member 14. Each keyway is also subjected to the resistance (friction) generated when the keys on the Oldham ring 26 slide.

Figure 2A:
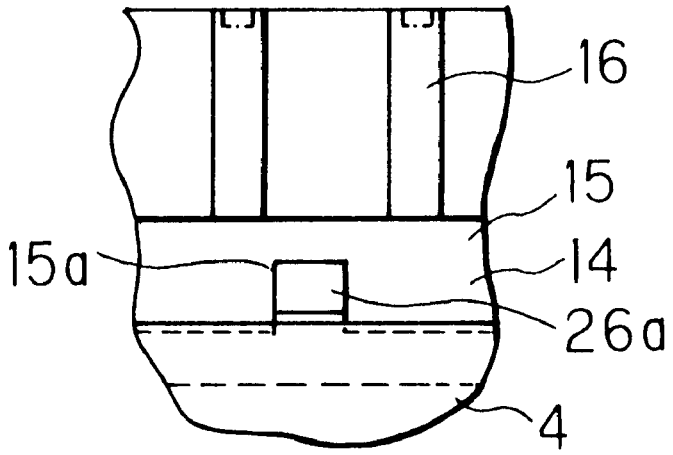
FIG. 2A PRIOR ART
FIGS. 2A and 2B show a part of a movable scroll member in FIG. 1 with an Oldham ring attached thereto.
Figure 2B:
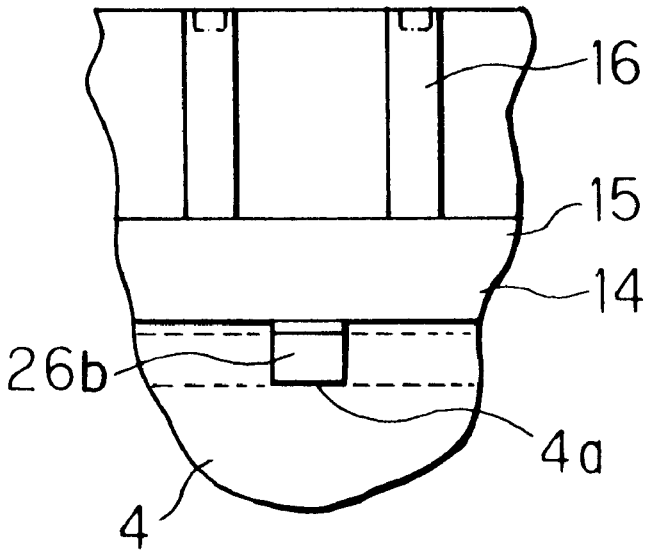
FIG. 2B PRIOR ART

Referring to FIG. 2A, a key 26*a* on the Oldham ring 26 is engaged with a keyway 15*a* formed in the end plate 15. FIG. 2B shows a perspective view obtained by the rotation of FIG. 2A by 90 degrees. In FIG. 2B, another key 26*b* on the Oldham ring 26 is engaged with a keyway 4*a* formed in the front end plate 4.

As apparent from FIGS. 2A and 2B, the Oldham ring 26 has four keys 26*a*, 26*a*, 26*b* and 26*b* equally apart from each other by 90 degrees.

With reference to FIG. 1 again, when the main shaft 7 rotates, the movable scroll member 14 is revolved through a revolving drive mechanism composed of, for example, the eccentric drive pin 25, the drive bush 21 and the boss 20. The movable scroll member 14 revolves along an orbit, with the Oldham ring 26 preventing the movable scroll member 14 from being self-rotated relative to the fixed scroll member 10. A revolving radius at that time is equal to an eccentric amount between the main shaft 7 and the eccentric drive pin 25. Therefore, the fluid pockets 19*a* and 19*b* get smaller and get closer to the center of the scroll member, as the line contact points on the side of the involute vanes 12 and 16 move toward the center.

The gas flown into the suction chamber 28 through a suction inlet (not shown) is entrapped by the fluid pockets 19*a* and 19*b* through the opening formed near the periphery of the involute vanes 12 and 16. The gas in the fluid pockets 19*a* and 19*b* reaches a central chamber 22 while being compressed continuously. The compressed gas flows from the chamber 22 through the discharge outlet 29. It opens a discharge valve which is not shown in the figure and is discharged into the discharge cavity 31. The compressed gas in the discharge cavity 31 is supplied to, for example, a refrigeration circuit through a discharge port which is not shown.

As described above, the Oldham ring 26 comprises several keys. The keys are used to fix the Oldham ring 26 to the front end plate 4 and the end plate 15 of the movable scroll member 14 within the compressor housing 1. Thus, it is necessary to form a keyway in, i.e., to spline the front end plate 4 and the movable scroll member 14.

The front end plate 4 and the movable scroll member 14 are typically made of iron-based material. In order to form a keyway in, for example, the front end plate 4, the latter is cut into a desired shape. The front end plate 4 is then ground and splined. The front end plate 4 may be subjected to heat treatment upon formation of the keyways.

Surface finishing with high accuracy is involved in the formation of the keyways to prevent seizure or abnormal abrasion or wear of the keys. To this end, cutting, grinding, and the heat treatment should be made. These works deteriorate productivity of the keyways, increasing the manufacturing cost for them. The heat treatment causes strain in the keyways, which may make it difficult to assemble the keys.

Problems arise when the movable scroll member 14 is subjected to heat treatment upon formation of the keyways. When the movable scroll member 14 is heated after being cut, the movable scroll member 14 would be deformed. On the contrary, when the movable scroll member 14 is heated before being cut, subsequent processes would be more difficult.

The front end plate 4 and the movable scroll member 14 may be made of the iron-based material, taking the wear resistance into consideration. However, such the iron-based material increases the weight of the fluid machine itself.

Figure 3:
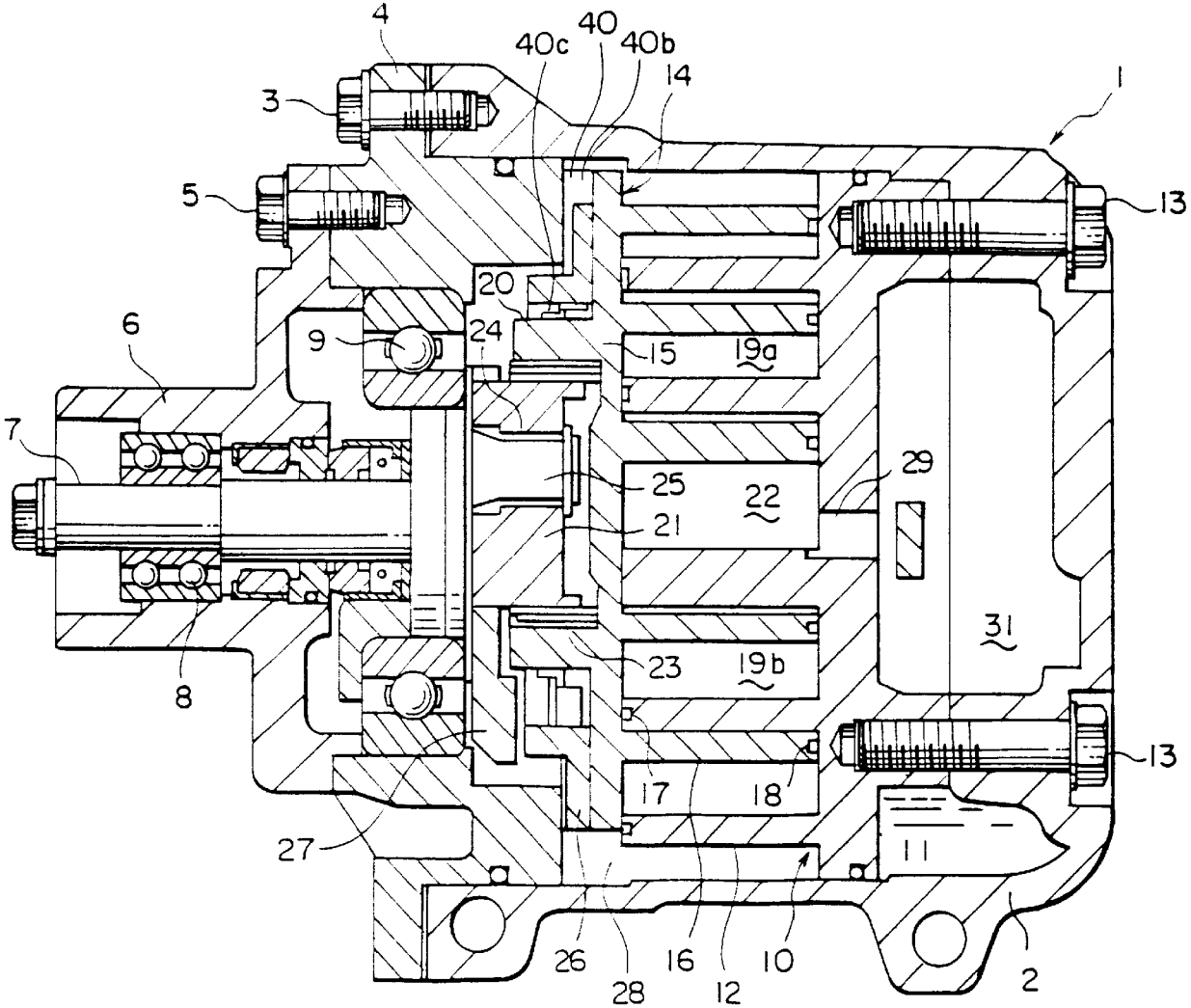
FIG. 3 is a cross-sectional view showing a scroll type fluid machine according to a preferred embodiment of the present invention.

Referring to FIG. 3, a scroll type fluid machine according to a preferred embodiment of the present invention is described. This scroll type fluid machine may be used as a compressor as in the fluid machine described in conjunction with FIG. 1. Therefore, similar components and parts to those illustrated in FIG. 1 are depicted by the same reference numerals and description thereof will be omitted below.

In FIG. 3, a self-rotation stop mechanism is placed between one side (left side in the figure) of the end plate 15 of the movable scroll member 14 and the front end plate 4. The self-rotation stop mechanism comprises a plate 40 having wear resistance along with the Oldham ring 26 illustrated in FIG. 1. The plate 40 supports the Oldham ring 26 as described below.

Figure 4A:
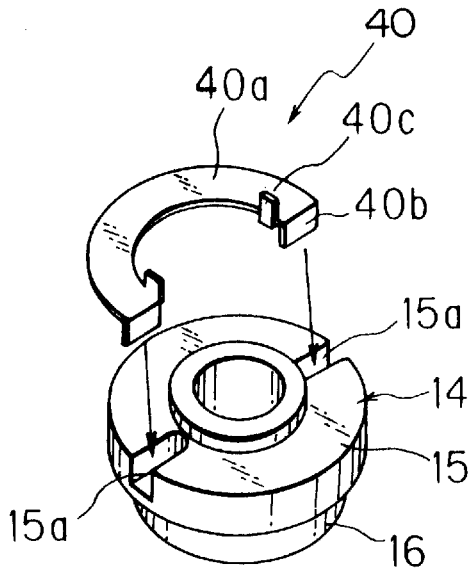
FIGS. 4A, 4B and 4C show a plate having wear resistance that is to be provided on the movable scroll member in FIG. 3.
Figure 4B:
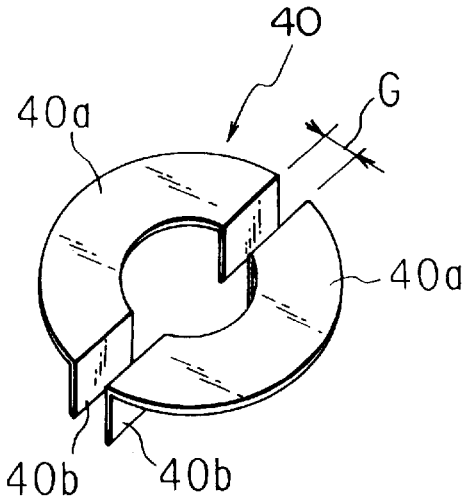

With reference to FIG. 4A in addition to FIG. 3, the end plate 15 of the movable scroll member 14 has a pair of keyways 15*a* at the positions symmetrical with each other. As shown in FIG. 4B, the plate 40 is formed of a pair of semi-circular members 40*a*. In FIG. 4A, only one semi-circular member 40*a* is shown. Both ends of the semi-circular member 40*a* are bent at right angles to the top surface of the plate 40 to form bent sections 40*b*. Projections 40*c* are formed on the inner periphery of the plate 40 near the respective ends of the semi-circular member 40*a*. Each projection 40*c* is extended in the opposite direction to the bent section 40*b* in the vicinity of the latter.

Figure 4C:
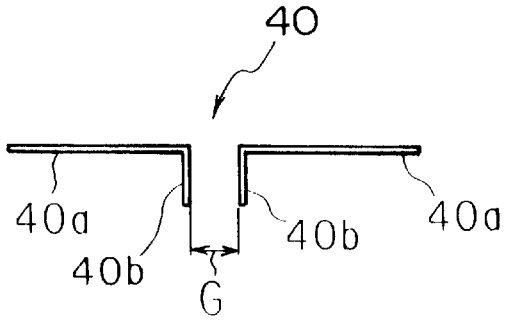

The semi-circular members 40*a* are assembled to form a circular member. In this event, the bent section 40*b* of the semi-circular member 40*a* engages the side of the keyway 15*a* and is placed within the keyway 15*a*. As shown in FIGS. 4B and 4C, the bent section 40*b* engages the side of the keyway 15*a* such that the semi-circular members 40*a* form the circular member with gaps G defined therebetween. In FIGS. 4B and 4C, the projections 40*c* are not shown. The gap G is approximately equal to the width of the keyway 15*a*.

Then, the keys on the above-mentioned Oldham ring 26 are engaged with the keyways 15*a*. In this event, the aforementioned projections 40*c* abut against the inner peripheral surface of the Oldham ring 26. In this embodiment, the keys on the front end plate 4 are also engaged with the keyways formed in the front end plate 4.

Figure 5A:
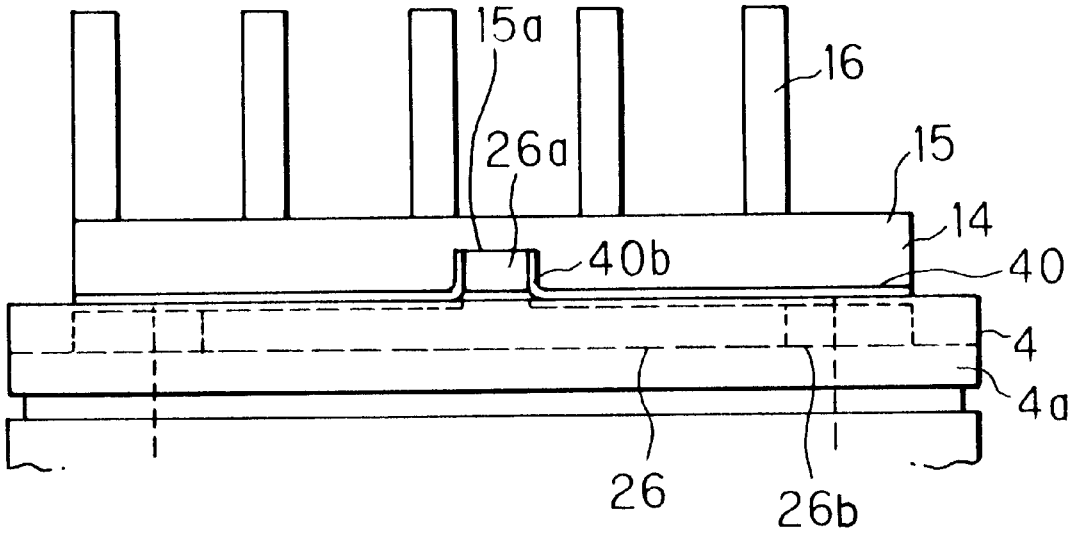
FIGS. 5A and 5B are views showing the plate in FIG. 4A having wear resistance that is attached to the movable scroll member.
Figure 5B:
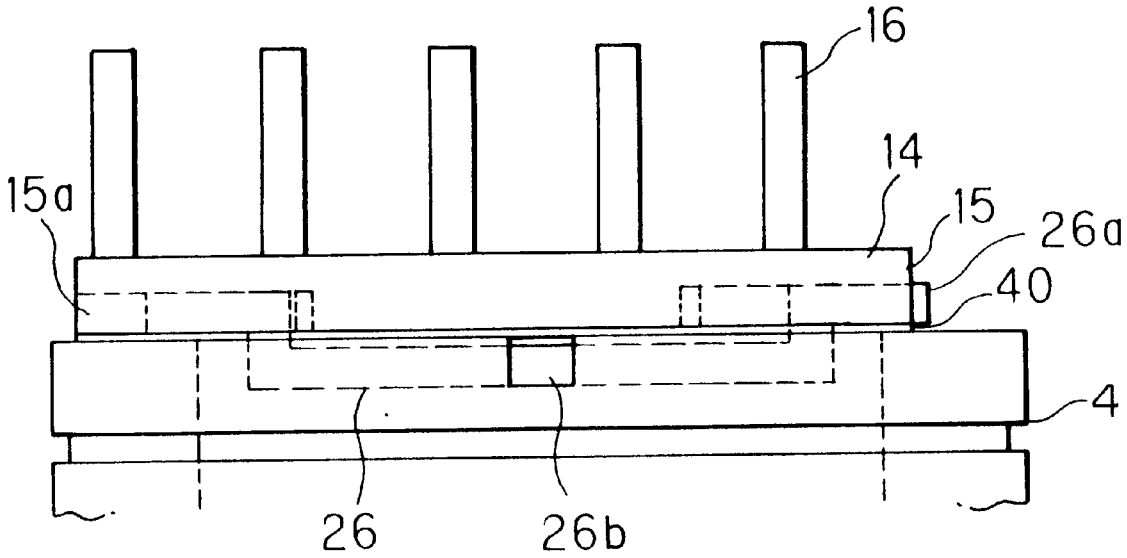

Referring to FIGS. 3 and 5A, the state shown in FIG. 5A is considered as zero degrees of the perspective. FIG. 5B shows a 90-degree rotated perspective from that in FIG. 5A.

The keys 26*a* are engaged with the keyways in the movable scroll member 14 in the state shown in FIG. 5A. The key 26*b* is engaged with the keyway in the front end plate 4 in the state shown in FIG. 5B. The relative position between those shown in FIGS. 5A and 5B is not changed after the movable scroll member 14 moves.

It is assumed that the Oldham ring 26 extends and retracts in the direction of 90 degrees relative to the front end plate 4, then the movable scroll member 14 moves in the direction of 0 degrees relative to the Oldham ring 26. Combination of these two movements results in revolving of the movable scroll member 14 relative to the front end plate 4.

In this event, a thrust loading acting on the movable scroll member 14 is applied to the plate 40 and the rear surface of the plate 40 come in contact with the front end plate 4. The keys 26*a* on the Oldham ring 26 contact with the bent sections 40*b* by to the reactive force from the movable scroll member 14 that is generated due to prevention of the rotation. The keys 26*b* slide on the contact surface. On the other hand, vibration in the radial direction of the plate 40 is restricted by the projections 40*c*.

The presence of the plate 40 eliminates the necessity of surface finishing with high accuracy which otherwise would be required to form the keyway in the front end plate 4 or the movable scroll member 14. Accordingly, the productivity is improved at a reduced cost.

Furthermore, assembling the keys into the keyways is facilitated because it is unnecessary to heat treat the front end plate 4 or the movable scroll member 14. The plate 40 can be manufactured with high accuracy by means of, for example, pressing. As described above, sliding of the keys is received by the bent sections 40*b* of the plate 40, so that material having low wear resistance such as aluminum may be used for the front end plate 4 or the movable scroll member 14 where the keyways are formed. Accordingly, the front end plate 4 and the movable scroll member 14 may be cut more easily and the weight thereof can be reduced.

The plate 40 is mounted on the movable scroll member 14 in the embodiment illustrated in FIG. 3. However, it may be mounted on the front end plate 4. Alternatively, the plate 40 may be mounted on both the movable scroll member 14 and the front end plate 4.

Figure 6A:
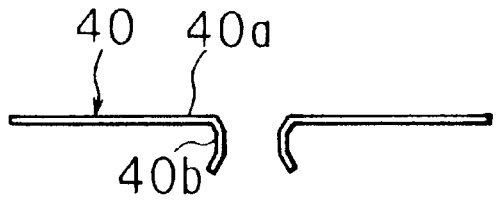
FIGS. 6A, 6B and 6C are views showing other examples of a bent section formed on the plate in FIG. 4A having wear resistance.
Figure 6B:
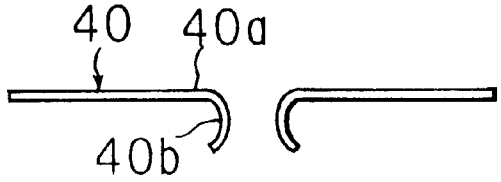
Figure 6C:
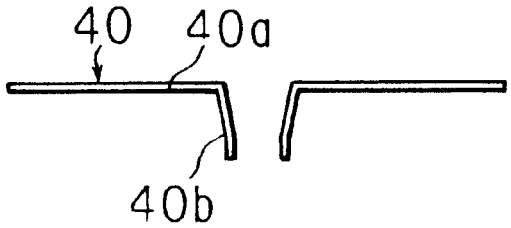

As shown in FIGS. 6A through 6C, the bent section 40*b* of the plate 40 may have a different shape. The bent section 40*b* in FIG. 6A is formed such that the outer surface is a convex. The bent section 40*b* in FIG. 6B is formed like an arc. The bent section 40*b* in FIG. 6C is formed by means of bending the plate 40 such that the opposite pair of bent sections 40*b* is closer at the edges thereof. The key on the Oldham ring 26 is elastically supported by the bent sections 40*b* in all cases shown in FIGS. 6A through 6C. Such elastic support of the key on the Oldham ring 26 eliminates necessity for precise cutting of the keyways. Accordingly, the keyways can be formed more easily.

Figure 7:
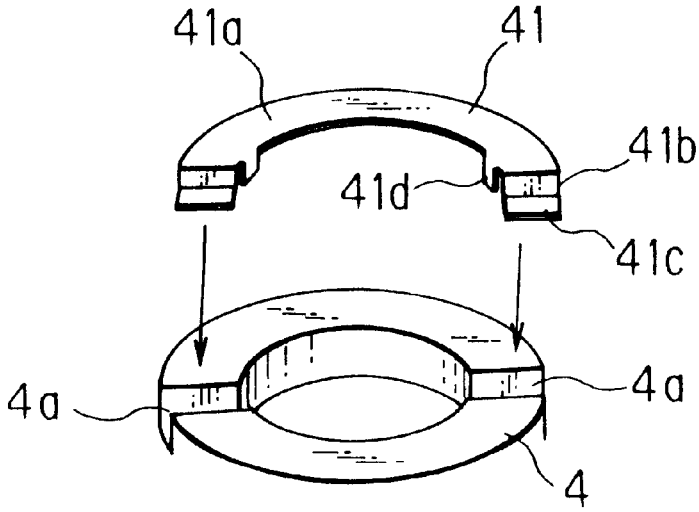
FIG. 7 is a view showing the plate having wear resistance that is provided on a front end plate in FIG. 3.
Figure 8:
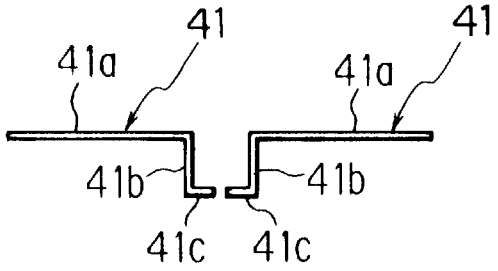
FIG. 8 is a view showing the positional relationship between the plate in FIG. 7 having wear resistance and a keyway in the front end plate when they are engaged with each other.

Referring to FIG. 7, a plate having wear resistance is described that is to be mounted on the front end plate 4. A plate 41 in the figure comprises semi-circular members 41*a*. Each semi-circular member 41*a* has bent sections 41*b* and edge sections 41*c*. The bent section 41*b* is formed by means of bending downward the end of the semi-circular member 41*a*. The edge section 41*c* extends from the bent section 41*b* in the extending direction of the semi-circular member 41*a*. Projections 41*d* are also formed on the semi-circular member 41*a* at the position close to the bent sections 41*b* on the inner periphery of the semi-circular member 41*a*.

A pair of keyways is formed in the front end plate 4 at the positions symmetrical with each other. The semi-circular members 41*a* are assembled to form a circular member. The bent section 41*b* of the semi-circular member 41*a* engages the side of the keyway 4*a* and is placed within it. In this event, the edge sections 41*c* are opposed to each other to form the bottom of the keyway.

The key on the above-mentioned Oldham ring (on the side of the front end plate) is then engaged with the keyway 4*a*. The above-mentioned protections 41*d* abut against the outer peripheral surface of the Oldham ring 26. In the embodiment illustrated, the keys on the Oldham ring 26 engage the keyways formed in the movable scroll member 14.

Figure 9A:
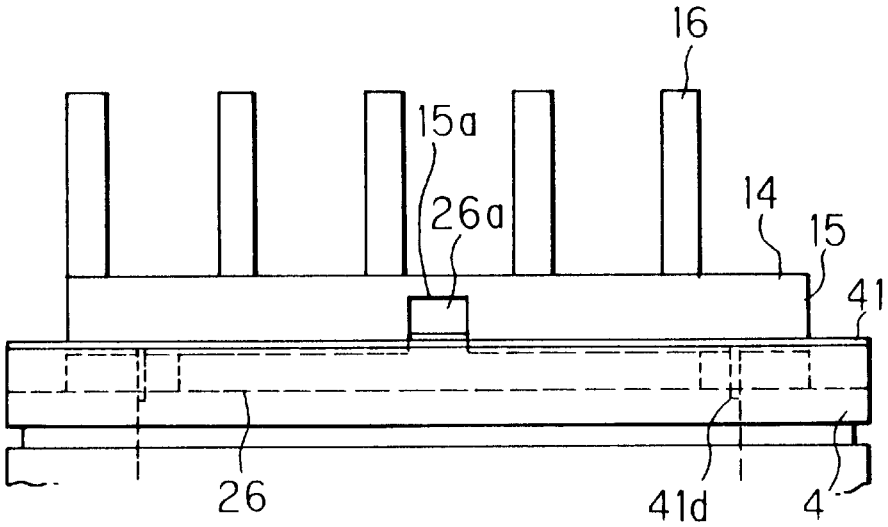
FIGS. 9A and 9B are views showing the plate in FIG. 7 having wear resistance that is fixed to the front end plate.
Figure 9B:
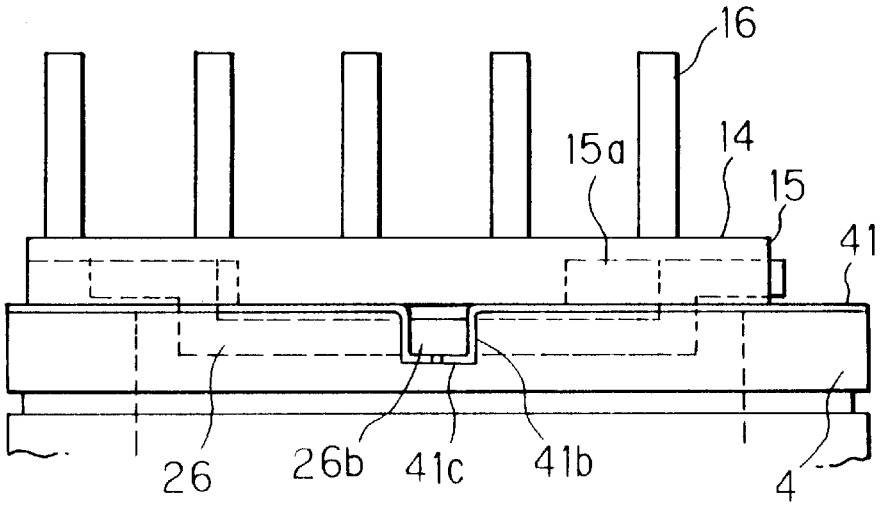

Referring to FIGS. 9A and 9B, the state shown in FIG. 9A is considered as zero degrees of the perspective. FIG. 9B shows a 90-degree rotated perspective from that in FIG. 9A.

The keys 26*a* engage the keyways in the movable scroll member 14 in the state shown in FIG. 9A. The key 26*b* engage the keyway in the front end plate 4 in the state shown in FIG. 9B. The relative position between those shown in FIGS. 9A and 9B is not changed after the movable scroll member 14 moves.

In this event, a thrust loading acting on the movable scroll member 14 is applied to the plate 41 and the rear surface of the plate 41 come in contact with the front end plate 4. The keys 26*b* on the Oldham ring 26 contact with the bent sections 41*b* and edge sections 41*c* to the reactive force from the movable scroll member 14 that is generated due to prevention of the rotation. The keys 26*b* slide on the contact surface. On the other hand, vibration in the radial direction of the plate 41 is restricted by the projections 41*d*.

Figure 10A:
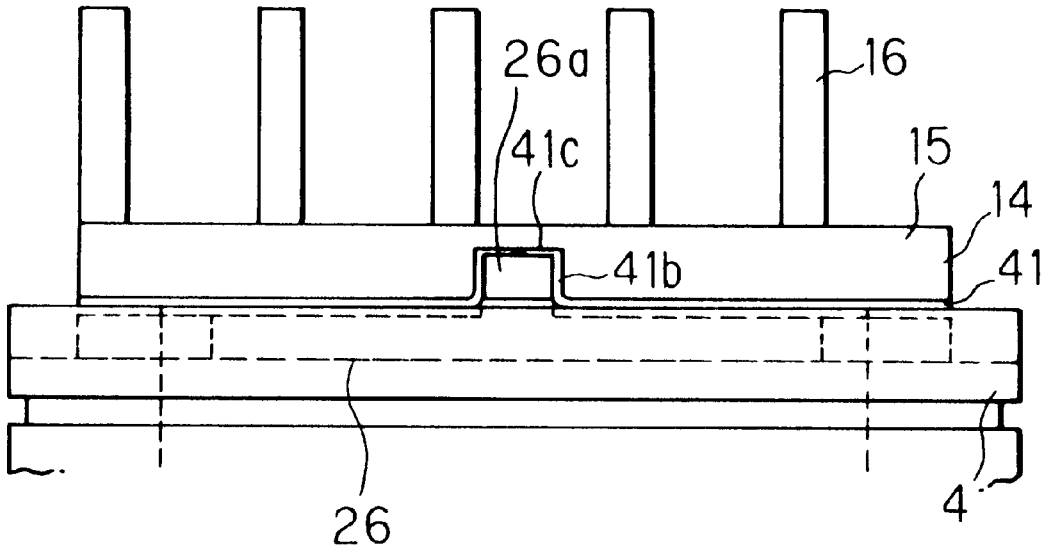
FIGS. 10A and 10B are views showing the plate in FIG. 7 having wear resistance that is fixed to the movable scroll member.
Figure 10B:
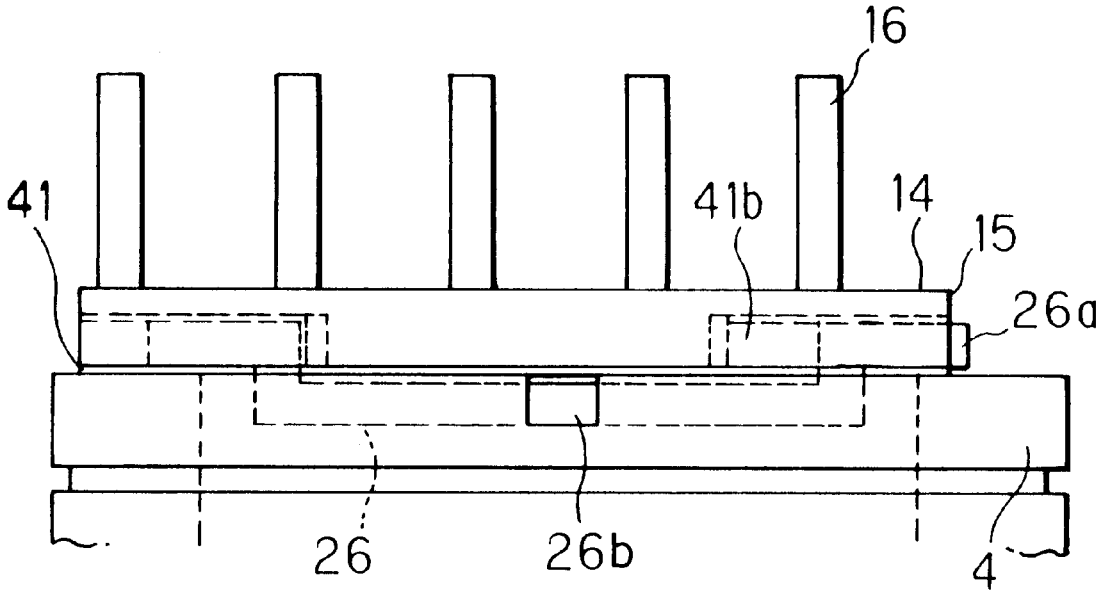

The plate 41 is placed on the front end plate 4 in the embodiment shown in FIG. 9 but the plate 41 may be placed on the movable scroll member 14 as shown in FIGS. 10A and 10B.

The edge sections 41*c* are formed at the ends of the semi-circular member 41*a* in the embodiment shown in FIG. 7 but the edge section 41*c* may be formed only at one end of the semi-circular member 41*a* as shown in FIG. 11. In such a case, the semi-circular members 41*a* are assembled such that the end thereof having the edge section 41*c* is opposed to the end of the other semi-circular member 41*a* having no edge section. In other words, one of the semi-circular members 41*a* is turned by 180 degrees to assemble the pair of semi-circular members 41*a*. The bottom of the keyway is formed of one edge section 41*c* as shown in FIG. 12.

This configuration reduces the number of machining processes for the semi-circular member 41*a* because only one edge section 41*c* is formed.

An elastic member 42 may be placed on the inner side surface of the bent section 40*b* or 41*b* as shown in FIGS. 13A and 13B. This further restricts vibration of the Oldham ring.

As described above, according to the present invention, the plate having wear resistance is placed on at least one of the movable scroll member or the front end plate. This eliminates the necessity of surface finishing with high accuracy which otherwise would be required to form the keyway in the front end plate or the movable scroll member. Accordingly, the productivity is improved at a reduced cost.

Furthermore, assembling the keys into keyways is facilitated because it is unnecessary to heat treat the movable scroll member or the front end plate. The plate having wear resistance can be manufactured with high accuracy by means of, for example, pressing. As described above, sliding of the keys is received by the bent sections of the plate having wear resistance, so that material such as aluminum that is less resistant against wear may be used for the movable scroll member or the front end plate where the keyways are formed. Accordingly, the movable scroll member or the front end plate and the movable scroll member may be machined more easily and the weight thereof can be reduced.

Furthermore, the key on the Oldham ring is elastically supported by the bent sections of the plate having wear resistance. Such elastic support of the key on the Oldham ring eliminates necessity for precise machining of the keyways. Accordingly, the keyways can be formed more easily.

What is claimed is:

1. A scroll type fluid machine comprising a compressor housing; a front end plate fixed within said compressor housing; a fixed scroll member; and a movable scroll member, said movable scroll member being displaced relative to said fixed scroll member within said compressor housing, said movable scroll member being let to cooperate with said fixed scroll member to orbit around said fixed scroll member while not allowed to self-rotate relative to said fixed scroll member by an Oldham ring, wherein:

said Oldham ring comprises a plurality of keys;

said front end plate and said movable scroll member having housing keyways and scroll keyways, respectively, formed therein, for receiving said keys;

a pair of semi-circular members having wear resistance being assembled to form a ring member on at least one of said front end plate and said movable scroll member, said semi-circular members receiving a thrust load acting on said movable scroll member;

the pair of semi-circular members each having ends bent to form bent sections, said bent sections being inserted into said housing keyway or said scroll keyway, said key being within said housing keyway or said scroll keyway when said bent section is within said keyway to receive sliding of said key by said bent section.

2. A scroll type fluid machine as claimed in claim 1, wherein said bent section is located on a side of said housing keyway or said scroll keyway.

3. A scroll type fluid machine as claimed in claim 1, wherein said bent section has a portion located on the side of said housing keyway or said scroll keyway and a portion located on the bottom of said housing keyway or said scroll keyway.

4. A scroll type fluid machine as claimed in claim 2 or 3, wherein said key is elastically supported by said bent section.

5. A scroll type fluid machine as claimed in claim 2 or 3, wherein said bent section is provided with an elastic member positioned between said bent section and the side of said housing keyway or said scroll keyway.

6. A scroll type fluid machine as claimed in claim 2 or 3, wherein said semi-circular member is formed by pressing.

* * * * *